US005669550A

United States Patent [19]

Klemme et al.

[11] Patent Number: 5,669,550

[45] Date of Patent: Sep. 23, 1997

[54] NON-ROUND CONTAINER HAVING MULTIPLE STORAGE COMPARTMENTS

[75] Inventors: Kirk Klemme, Liberty; Ronald D. Robertson, Kansas City, both of Mo.

[73] Assignee: Sealright Co., Inc., DeSoto, Kans.

[21] Appl. No.: 573,532

[22] Filed: Dec. 15, 1995

Related U.S. Application Data

[63] Continuation-in-part of Ser. No. 42,338, Aug. 8, 1995, and a continuation of Ser. No. 42,339, Aug. 8, 1995, and a continuation of Ser. No. 517,643, Aug. 22, 1995.

[51] Int. Cl.[6] ..... B65D 5/42

[52] U.S. Cl. ..... 229/4.5; 229/5.5; 229/125.05; 229/125.25

[58] Field of Search ..... 229/4.5, 5.5, 5.8, 229/125.05, 125.17, 125.25; 220/521

[56] References Cited

U.S. PATENT DOCUMENTS

| | | | |
|---|---|---|---|
| 1,173,284 | 2/1916 | Leiman | 229/4.5 |
| 1,733,674 | 10/1929 | Schleicher | 229/5.5 |
| 2,007,347 | 7/1935 | Rutkowski | 229/5.5 |
| 3,112,824 | 12/1963 | Lemelson | 220/521 |
| 3,214,074 | 10/1965 | Schechter | 229/125.05 |
| 3,344,912 | 10/1967 | Sternau | 229/125.25 |
| 3,445,049 | 5/1969 | Carpenter, Jr. | 229/4.5 |
| 3,679,093 | 7/1972 | Chang | 229/125.05 |
| 4,154,360 | 5/1979 | Smith | 229/125.15 |
| 4,632,298 | 12/1986 | Schellenberg | 229/125.17 |
| 4,955,531 | 9/1990 | Graboyes | 229/4.5 |

FOREIGN PATENT DOCUMENTS

| | | | |
|---|---|---|---|
| 4908 | 7/1902 | Denmark | 229/5.5 |
| 668824 | 11/1929 | France | 229/5.5 |
| 372468 | 5/1932 | United Kingdom | 229/5.5 |
| 444725 | 3/1936 | United Kingdom | 229/4.5 |
| 622755 | 5/1949 | United Kingdom | 229/4.5 |

*Primary Examiner*—Gary E. Elkins

*Attorney, Agent, or Firm*—Kokjer, Kircher, Bowman & Johnson

[57] ABSTRACT

A non-round convolute paperboard container comprising a closed bottom and an upstanding continuous sidewall which together form a main storage cavity for storing goods. The container includes a closure lid which forms a lid compartment for separately storing goods apart from goods stored in the main cavity. The closure lid may take the form of a recessed well, a dome cover or a combination of the two. The container when viewed transversely of its longitudinal axis is curvilinear oblong or oval in shape such that oblong objects such as serving utensils or marketing toys can be stored within the lid compartment.

21 Claims, 2 Drawing Sheets

NON-ROUND CONTAINER HAVING MULTIPLE STORAGE COMPARTMENTS

This application is a Continuation-In-Part application of U.S. Design patent applications Ser. No.29/042,338 filed Aug. 8, 1995 pending and Ser. No. 29/042,339 filed Aug. 8, 1995, pending and of U.S. patent application Ser. No. 08/517,643 filed Aug. 22, 1995, pending.

BACKGROUND OF THE INVENTION

1. Field of the Invention

The present invention is generally directed to the container and packaging industry, and is more specifically directed to a non-round oblong container having two or more compartments suitable for separately storing multiple products within the same container.

2. Description of the Related Art

Containers used for storing grocery and other consumer oriented products commonly serve the dual function of storage receptacle and product packaging. In order to accommodate these functions, the promotional and display characteristics of the container may be as important as storage, shipment and user friendly considerations when designing new container configurations.

The challenges facing the container design industry in this respect can be illustrated by reference to those containers used in packaging dairy products such as ice cream, sherbet, yogurt and cottage cheese. In the past, rectangular paperboard boxes and circular canisters have been utilized for purposes of storing dairy products. While these prior art designs have proven useful, there is a continued need for new and improved models addressing not only storage and use requirements, but also promotional and marketing needs. For instance, the containers need to be easy to use, to provide a convenient package from which to dispense the product, and to be durable for purposes of storage and shipment. However, the containers also need to provide sufficient "billboard" space for displaying product and/or marketing information and to have an overall configuration that enhances efficient shelving and prominent or unique display.

Depending upon the type of product being packaged, it may likewise be desirable to provide a means for the inclusion of a marketing premium, such as a toy prize, within the product packaging. In addition, it may be desirable to include a complimentary product which compliments use of the primary product being contained. This is particularly true in the single serving container field where food items such as ice cream or yogurt are sold in a single serving for immediate consumption, such as at convenience stores or outdoor events. In those instances it would be preferable to include a spoon or other serving utensil within the product packaging. Furthermore, it may be desirable to include a complimentary product such as chocolate topping or nuts within the packaging for complimentary use with the ice cream.

In the past, inclusion of marketing premiums, spoons or complimentary toppings has proven difficult with conventional container configurations. The items must be wrapped or contained in such a manner as to protect the item from contamination, to retain the item separated from the primary product being stored, to minimize bulkiness or inconvenient packaging for storage and shipment, and preferably to be visible to the consumer when on display in the store. While conventional round canisters or box container configurations have been found generally useful for packaging a variety of items, the box and canister designs do not provide a means for separately storing secondary products in a convenient, non-bulky and high visibility manner.

SUMMARY OF THE INVENTION

It is therefore an object of the present invention to provide a container for containing dry, semi-dry and liquid products that is relatively inexpensive to produce and easy to use and store.

It is another object of the present invention to provide a container having a front and a back panel for ease in display of marketing and instructional indicia.

A related object of the present invention is to provide a container having a front and back panel that is easily distinguishable for purposes of shelving and display.

Yet another object of the present invention is to provide a container having a large continuous surface area for the prominent display of marketing and instructional indicia.

Another object of the present invention is to provide such a container for holding a primary product and having one or more other storage compartments for separately storing marketing or complimentary products.

Still a further object of the present invention is to provide a container having a main storage compartment within the body of the container and a separate storage compartment formed within the lid or cover of the container.

Yet another object of the present invention is to provide a container having a main storage compartment within the body of the container for holding a primary product and a second compartment for securely retaining a spoon or other serving utensil.

Still another object of the present invention is to provide a container having a main compartment within the body of the container for storing a primary food product and a second compartment for separately storing a complimentary product such as a liquid topping, nuts or crunchy candies.

Another object of the present invention is to provide a container having a display compartment within the upper portion or lid of the container for storing and/or displaying promotional or marketing items.

A further object of the invention is to provide a single serving container having a main storage compartment for storing a dry, semi-dry or liquid primary product and a separate compartment within the lid or upper section of the container for displaying and storing separately from the main compartment a dry, semi-dry or liquid product, wherein the container is curvilinear and oblong in shape so as to accommodate storage of an oblong product.

SUMMARY OF THE INVENTION

These and other objects are achieved by a container or vessel which is uniquely curvilinear and oblong or oval in shape when viewed in transverse cross section. The container has a continuous sidewall wrapped about the longitudinal axis of the container which extends upwardly from a closed bottom and terminates in an upper rim. The closed bottom and continuous sidewall together form a main storage cavity which is accessible through an open top bounded by the upper sidewall and upper rim. The open top of the main cavity is covered by a closure lid. The closure lid is configured so as to form a lid compartment separate from the main cavity and which may be used for storing items separately from the main cavity.

By virtue of its oval or oblong shape, the container has broad front and back sidewall panels which provide an expansive "billboard" space on which marketing and/or instructional indicia may be displayed. Yet its curvilinear nature enables a continuous display of marketing indicia beyond the front or back of the container without significant interruption. This configuration is also easy to stack and shelve—the "front" of the container is easily distinguishable so as to facilitate proper positioning on the shelves, and the design does not waste significant shelf space. Another particularly advantageous feature of this shape is that elongate items such as serving utensils (e.g. spoons, forks or knives) and promotional premiums (e.g. toy cars or action figures) can be conveniently stored and/or displayed within the confines of the lid compartment.

In one embodiment of the invention, the closure lid comprises an upstanding dome adapted to be releasably secured along its base to the upper rim of the container. The compartment formed within the upstanding dome can be used to store product. A planar sheet or membrane of plastic, paperboard or other suitable material extending across the open top of the main cavity and affixed along the upper rim may be provided to separate the main cavity from the lid compartment. The upstanding dome closure lid may optionally be comprised of a unitary piece of clear plastic such that utensils or promotional items stored within the confines of the lid compartment are protected from theft and/or contamination, yet also visible to the consumer for purposes of enticing the purchase of the product.

In a second embodiment of the invention, the closure lid comprises a recessed well having a closed bottom and upstanding continuous lid sidewall which terminates in an upper lid rim. The recessed well is configured to snugly fit within the confines of the upper portion of the main storage cavity of the container. This recessed well forms a separate compartment from that of the main cavity and may be utilized for storing a variety of goods (e.g. chocolate topping for complimentary use with ice cream stored in the main cavity). The recessed well may be covered with a releasable cover attached along the upper lid rim. Preferably, the releasable cover comprises a clear plastic or laminate cover such that the contents stored within the recessed well are visible to the purchasing public.

In a further embodiment of the invention, the recessed well may be covered with an upstanding dome closure lid as earlier described so as to define a large storage compartment comprising the recessed well and dome lid compartment. A planar sheet or membrane can be affixed to the upper lid rim of the recessed well if desired to separate the lid compartments formed by the recessed well and the upstanding dome closure, thus providing three separate compartments within the container.

BRIEF DESCRIPTION OF THE DRAWINGS

These and other objects and features of the present invention are explained in more detail with reference to the drawings, in which like reference numerals denote like elements, and in which.

DETAILED DESCRIPTION OF THE INVENTION

Figure 2:
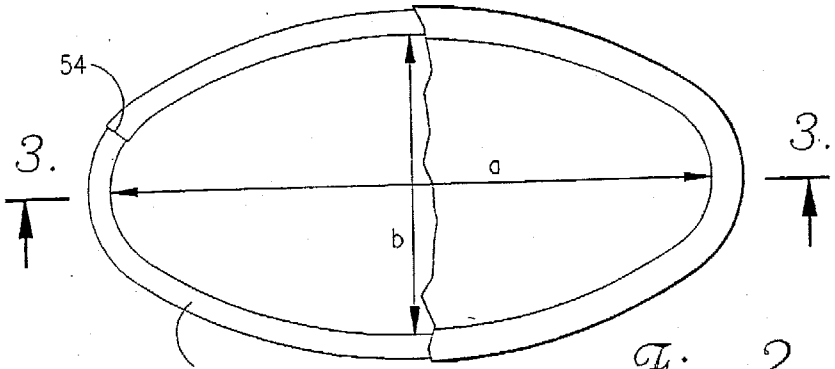
FIG. 2 is a fragmented top plan view of the container of FIG. 1 showing the top of the container with and without the dome closure lid thereon.

Referring now to the drawings in more detail, a container in accordance with a preferred embodiment of the present invention is generally designated by the reference numeral 10. Container 10 comprises a closed flat bottom 12, and an upstanding continuous sidewall 14 which is wrapped about the longitudinal axis of the container. Sidewall 14 extends vertically upward from the outer periphery of bottom 12 and terminates in an outwardly rolled upper rim 16. Sidewall 14 and bottom 12 together form a main storage cavity 18 for receiving and storing dry, semi-dry and/or liquid products. Main storage cavity 18 is accessible through an open top which is bounded by the upper rim 16.

Figure 1:
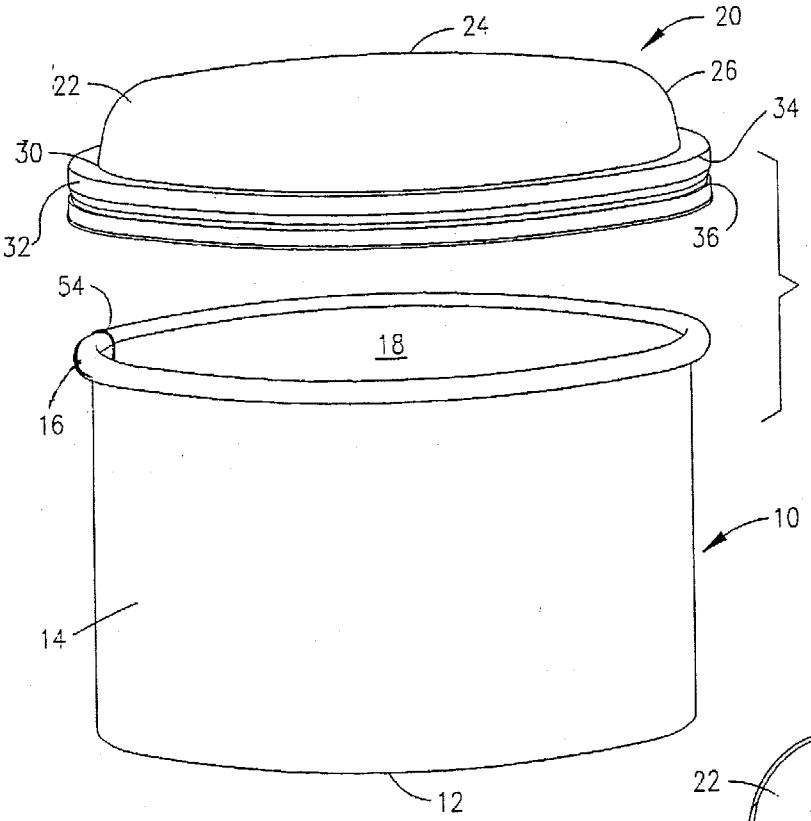
FIG. 1 is a perspective view of the front of a container and an upstanding dome closure lid in accordance with the present invention.

Best shown with reference to FIGS. 1 and 2, the container is curvilinear and oblong or oval in shape when viewed transversely of its longitudinal axis. This shape is more specifically defined by a major axis a that is of greater length than minor axis b. The curvilinear and oblong shape of the container results in relatively broad front and back sidewall panels generally aligned parallel with major axis a. The front and back sidewall panels are connected by curved side panels having a smaller radius of curvature than the broad front and back panels.

Container 10 includes a closure lid which is adapted to releasably close the open top of the main storage cavity 18 and to provide a lid compartment for separately storing a product from that contained in main cavity 18. In one embodiment as shown in FIGS. 1–4, the closure lid comprises an upstanding dome closure lid 20 which may be formed of any suitable material known in the art, and preferably is formed of molded clear plastic. Closure lid 20 includes an upstanding dome member 22 comprised of a rounded or planar closed top 24 and continuous lid sidewall 26 which extends downwardly to an open bottom base 30. The closed top 24 and downwardly extending lid sidewall 26 together form a lid compartment or cavity 28 in which product may be stored. A peripheral rim attachment 32 having a peripheral shoulder 34 extending outwardly and downwardly from base 30 of the dome member is provided for releasably affixing the closure lid 20 to the upper rim 16 of the container. The downwardly extending portion of the shoulder 34 includes an inwardly extending groove 36 which fits securely under the upper rim of the container to form a snap lock or interference fit when affixed to the container.

Figure 3:
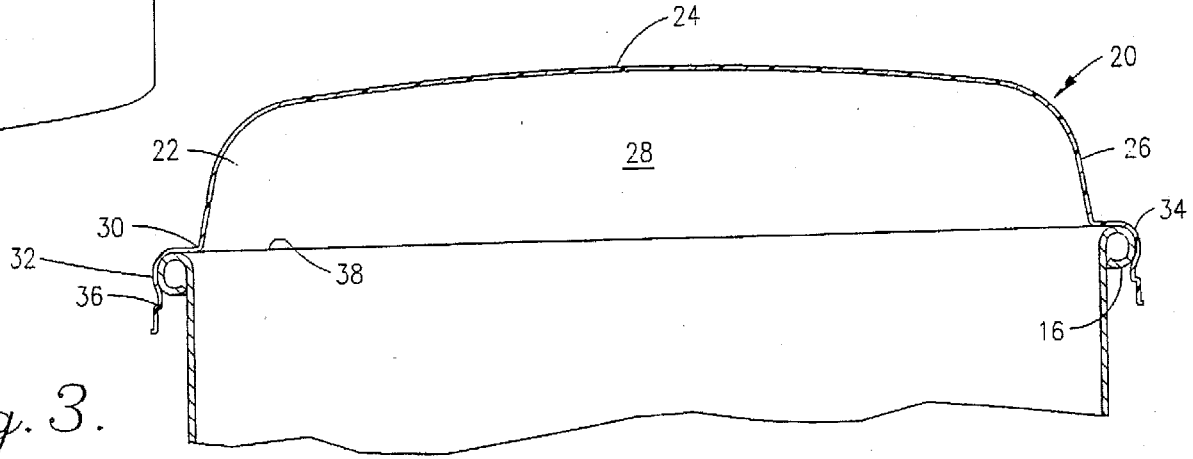
FIG. 3 is a fragmentary detail displaying a sectional view of the upper portion of the container and the dome closure lid taken along line 3—3 of FIG. 2 in the direction of the arrows.
Figure 4:
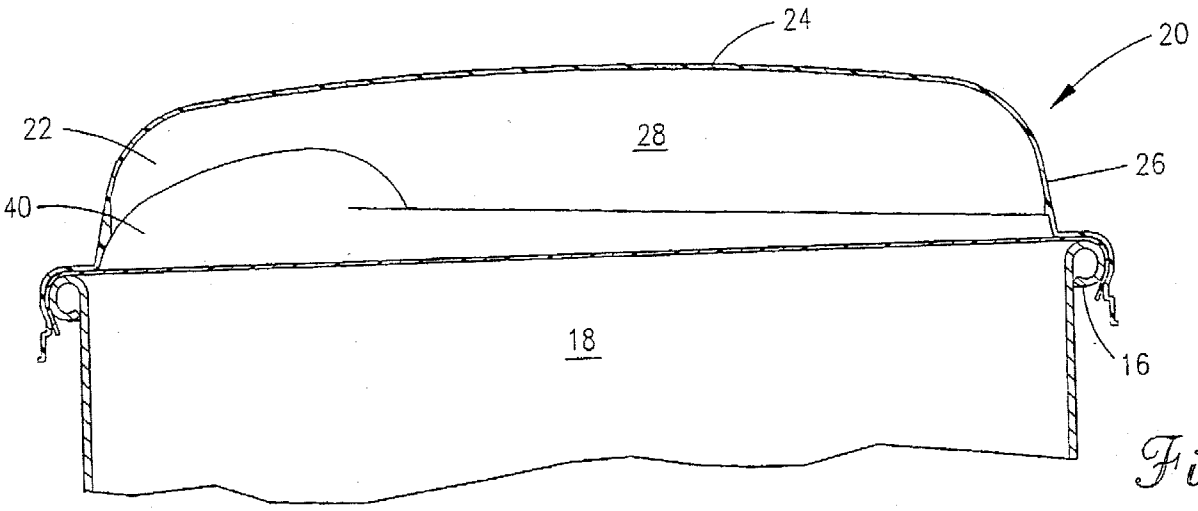
FIG. 4 is a fragmentary detail displaying a sectional view of the upper portion of the container and the dome closure lid taken along line 3—3 of FIG. 2 in the direction of the arrows additionally including a spoon contained within the lid compartment of the upstanding dome closure lid.

The lid compartment 28 formed by the upstanding dome closure lid may be used as extended storage space for the main storage cavity 18 of the container, or may serve as a storage compartment separate from the main cavity. In this latter instance, a planar sheet or membrane 38 of flexible material may be secured across the open top of the main cavity to separate the main cavity 18 from the lid compartment 28. The sheet may be formed of a flexible material such as foil, paper, plastic film, or laminate. The sheet will have a size and peripheral configuration similar to that of the open top of the container such that the sheet may be secured to the inner or outer face of the container sidewall along the upper rim. The sheet may be secured by any method known in the art including adhesives, ultrasonic or thermal bonding, or cold pressure bonding. This embodiment of the invention is best shown in FIGS. 3 and 4. Note in FIG. 4 that a spoon 40 or other elongated utensil or speciality marketing premium may be placed within the lid compartment for secure and protective enclosure yet remain separated from the primary product contained within the main cavity 18.

Figure 5:
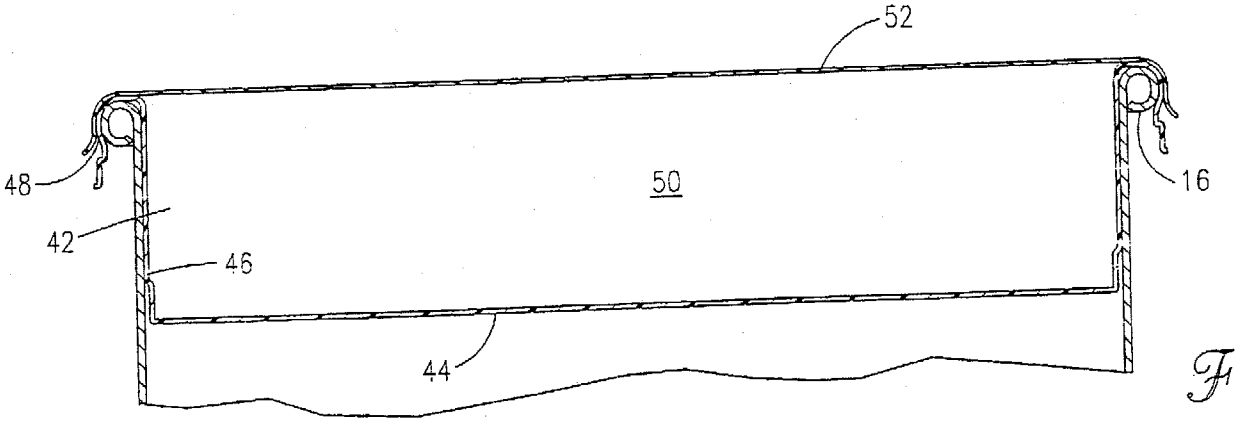
FIG. 5 is a fragmentary detail displaying in cross-section the upper portion of a container in accordance with a second embodiment of this invention including a recessed well as the closure lid.

In a second embodiment of the invention shown in FIG. 5, the closure lid optionally includes a recessed well 42 having a closed lid bottom 44 conforming generally in size and shape to the open top of the container. Continuous upstanding lid side wall 46 extends upwardly from closed lid bottom 44 terminating in an outwardly rolled lid rim 48 configured to securely fit over and around upper rim 16. The upper lid rim 48 may be configured to snap lock or form an interference fit around the upper rim 16. The recessed well 42 is configured so as to fit snugly within the confines of the upper portion of the container side wall 14 thus forming a separate lid compartment 50 for separately storing product from that contained in the main cavity below. A releasable cover 52 is provided to close the open top of the recessed well. Any form of cover suitable for covering the recessed well and for secure attachment along the upper lid rim 48 and/or container upper rim 16 is considered suitable for this purpose. In one embodiment, the releasable lid cover is formed of a planar sheet or membrane 52 of flexible material which is secured along the upper lid rim 48. The sheet may be formed of a flexible material such as foil, paper, plastic film, or laminate. The sheet will have a size and peripheral configuration similar to that of the open top of the recessed lid such that the sheet may be secured to the inner or outer face of the lid sidewall 46 along the upper lid rim 48. The sheet may be secured by any method known in the art including adhesives, ultrasonic or thermal bonding, or cold pressure bonding. Preferably, this sheet 52 is made of a clear plastic material or laminate such that the product contained within the recessed well is visible to the purchasing public.

In an alternative embodiment of the invention not shown in the drawings, it is envisioned that the upstanding dome closure lid 22 as heretofore described may optionally be used in conjunction with the recessed well 42 to provide a large secondary cavity comprising the lid compartments of both the recessed well 42 and the upstanding dome closure lid 20. Optionally, a planar sheet or membrane of foil, cellophane, or other plastic material may be extended across the open top of the recessed well in order to divide or separate the lid compartments of the recessed well and the upstanding dome closure, thereby forming three storage compartments within the container.

The container may be made as a "convolute" paperboard container meaning that the upstanding sidewall 14 is formed from a single sheet or blank of paperboard wrapped about the longitudinal axis of the container with the side edges of the blank being brought together and affixed in overlapping relation to form a side seam 54. The paperboard blank is generally in the form of a square or rectangular sheet of paperboard having top, bottom and side edges. The blank is wrapped about the longitudinal axis of the container such that the top edge of the paperboard blank forms upper rim 16 and the bottom edge of the paperboard blank is secured to bottom 12. The bottom edge of the paperboard is secured to bottom 12 using any means known in the art including adhesives and heat sealing means.

The side edges of the paperboard blank forming the sidewall are brought together and secured in overlapping relation to form a side seam 54 extending vertically from bottom 12 to upper rim 16. The side edges may be secured together to form the side seam using any means known in the art including adhesives and heat sealing means. In a most preferred embodiment, the side seam is provided in an "offset" position along the sidewall as hereafter described so as to enhance the quality of "billboard" space provided by the container sidewall for marketing and/or instructional indicia. To this end, the side seam is positioned outside the main viewing perspective of one examining the front or back of the container such that a major portion of the front and back sidewall panels respectively remains uninterrupted by the side seam. Preferably, the side seam is positioned outside of the front and back panels altogether and is instead positioned within the confines of one of the curved side panels. This embodiment is more fully described in U.S. patent application Ser. No. 08/517,643 filed Aug. 22, 1995, and incorporated by reference herein.

The material used to form the container sidewall, bottom, sealing divider and recessed well lid optionally includes a paperboard stock core having inner and outer faces coated with a barrier material. Such material is typically formed of heat sealable plastic and well known in the prior art. The barrier coating serves to provide moisture and/or gas barriers such that the contents of the container do not degrade the structural integrity of the paper. These barriers also serve to prevent contamination of the contents stored within the container.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A container for storing and packaging one or more dry, semi-dry and/or liquid goods, the container having a longitudinal axis and comprising:

a closed bottom;

a continuous sidewall wrapped about said longitudinal axis and extending upwardly from said closed bottom to an upper rim, wherein said sidewall forms a curvilinear and oblong shaped perimeter about the container when viewed transversely of its longitudinal axis and wherein said closed bottom and said sidewall together form a main storage cavity in which said one or more goods may be stored and which is accessible through an open top bounded by said upper rim; and a closure lid adapted to releasably close said open top wherein said closure lid forms a lid compartment in which said one or more goods may be stored.

2. A container in accordance with claim 1, wherein said sidewall forms an oval oblong shaped perimeter about the container when viewed transversely of its longitudinal axis.

3. A container in accordance with claim 1, wherein said closure lid comprises an upstanding dome closure lid having a closed top and downwardly extending sidewalls which together form the lid compartment which is accessible from an open bottom.

4. A container in accordance with claim 3, wherein said dome closure lid is releasably attached to said container to close said open top.

5. A container in accordance with claim 4, wherein said dome closure lid is releasably attached to said upper rim of the container.

6. A container in accordance with claim 3, wherein said dome closure lid is constructed of a clear plastic material.

7. A container in accordance with claim 3, wherein said container additionally comprises a planar sheet spanning the open top of said main storage cavity to separate said main storage cavity from said lid compartment.

8. A container in accordance with claim 7, wherein said planar sheet is releasably attached to the upper rim of said container.

9. A container in accordance with claim 7, wherein the planar sheet is selected from the group consisting of foil, paper, plastic film, laminate and combinations thereof.

10. A container in accordance to claim 1, wherein said closure lid comprises a recessed well having a closed bottom of size and peripheral configuration similar to that of the open top of the container, upstanding lid sidewalls and an open top.

11. A container in accordance with claim 10, wherein said recessed well is configured to fit within the confines of the sidewall of the container.

12. A container in accordance with claim 10, wherein said recessed well additionally comprises a lid rim configured to fit over and around the upper rim of the container.

13. A container in accordance with claim 10, wherein said container additionally comprises a cover to close said open top of the recessed well.

14. A container in accordance with claim 13, wherein said cover comprises a dome shaped cover having a closed top and downwardly extending sidewalls.

15. A container in accordance with claim 14, wherein said container additionally comprises a planar sheet spanning the open top of said recessed well to separate the recessed well from the dome shaped cover.

16. A container in accordance with claim 15, wherein said planar sheet is formed of a flexible material selected from the group consisting of foil, paper, plastic film, laminate, and combinations thereof.

17. A container in accordance with claim 1, wherein said container is formed of paperboard.

18. A container in accordance with claim 17, wherein said paperboard is coated with a barrier material.

19. A container in accordance with claim 18, wherein said barrier material is selected from the group consisting of a heat sealable plastic material.

20. A container for storing and packaging one or more dry, semi-dry and/or liquid goods, the container comprising:

a closed bottom having an outer periphery that is curvilinear and oblong in shape;

an upstanding sidewall extending from the outer periphery of said closed bottom and terminating in an upper rim such that the bottom and sidewall together define a main storage cavity in which said one or more goods may be stored and which is accessible through an open top bounded by the upper rim, wherein said sidewall forms a broad front sidewall panel and a broad back sidewall panel and wherein said container additionally comprises a side seam extending along the sidewall from said closed bottom to said upper rim in an offset position such that a major portion of said broad front sidewall panel and said broad back sidewall panel remains uninterrupted by the side seam; and a closure lid adapted to releasably close said open top wherein said closure lid forms a lid compartment in which said one or more goods may be stored separately from said one or more goods stored in said main storage cavity.

21. A container for storing and packaging dry, semi-dry or liquid goods, said container having a longitudinal axis and comprising:

a closed bottom having an outer periphery that is curvilinear in shape;

an upstanding sidewall extending from the outer periphery of said closed bottom and terminating in an upper rim such that the sidewall and closed bottom together define a main storage cavity accessible through an open top bounded by said upper rim, the sidewall being formed from a sheet of paperboard wrapped about the longitudinal axis of said container, said sheet of paperboard including side edges that are secured together in overlapping relation to form a side seam extending from said closed bottom to said upper rim, the container when viewed transverse of said longitudinal axis is curvilinear and oblong in shape such that the sidewall comprises a broad front panel connected to a broad back panel by curved side panels and wherein the side seam is in an offset position along said sidewall such that a major portion of said broad front panel and said broad back panel remains uninterrupted by the side seam; and a closure lid adapted to releasably close said open top wherein said closure lid forms a lid compartment in which said one or more goods may be stored separate from said main storage cavity.

* * * * *